US007413521B2

(12) United States Patent
Cherry

(10) Patent No.: US 7,413,521 B2
(45) Date of Patent: Aug. 19, 2008

(54) PORTABLE PROTECTION SCREEN FOR PITCHING MACHINE

(76) Inventor: Kim Cherry, 22345 Can Ada Rd., Star, ID (US) 83669-5037

( * ) Notice: Subject to any disclaimer, the term of this patent is extended or adjusted under 35 U.S.C. 154(b) by 384 days.

(21) Appl. No.: 11/319,304

(22) Filed: Dec. 27, 2005

(65) Prior Publication Data

US 2007/0123369 A1 May 31, 2007

Related U.S. Application Data

(60) Provisional application No. 60/597,345, filed on Nov. 26, 2005.

(51) Int. Cl.
*A63B 69/00* (2006.01)

(52) U.S. Cl. ..... 473/451; 473/468

(58) Field of Classification Search ..... 473/451, 473/431, 422, 417, 419, 420, 434, 456, 462, 473/184; 124/29.7; 273/401; D21/705; 296/26.11, 24.42; 160/369
See application file for complete search history.

(56) References Cited

U.S. PATENT DOCUMENTS

| | | | | | |
|---|---|---|---|---|---|
| 1,198,300 | A * | 9/1916 | Watkins | 124/6 |
| 2,254,986 | A * | 9/1941 | Ziel | 473/454 |
| 2,873,969 | A * | 2/1959 | Ziel | 473/456 |
| 4,074,905 | A | 2/1978 | High | |
| 4,173,337 | A * | 11/1979 | Okonowski | 473/456 |
| 4,470,228 | A * | 9/1984 | Dirck | 52/106 |
| 4,524,749 | A | 6/1985 | Giovagnoli | |
| 4,883,272 | A * | 11/1989 | Lay | 473/436 |
| 5,118,103 | A | 6/1992 | Miller | |
| 5,174,565 | A * | 12/1992 | Komori | 124/7 |
| 5,195,744 | A | 3/1993 | Kapp et al. | |
| 5,439,212 | A * | 8/1995 | Hart | 124/7 |
| 5,573,239 | A * | 11/1996 | Ryker et al. | 473/436 |
| 5,722,905 | A | 3/1998 | Bidelman | |
| 5,897,445 | A | 4/1999 | Sanders | |
| 6,026,798 | A | 2/2000 | Sanders et al. | |
| 6,102,021 | A | 8/2000 | Sanders et al. | |
| 6,550,491 | B1 | 4/2003 | Bixler et al. | |
| 6,884,188 | B2 * | 4/2005 | Cherry | 473/451 |
| 6,955,615 | B1 * | 10/2005 | Cavell | 473/451 |
| 7,056,239 | B2 * | 6/2006 | Hickman, Jr. | 473/454 |
| 2004/0178585 | A1 * | 9/2004 | Cosenza | 273/454 |

* cited by examiner

*Primary Examiner*—Gene Kim
*Assistant Examiner*—M Chambers
(74) *Attorney, Agent, or Firm*—Stephen M. Nipper; Dykas, Shaver & Nipper, LLP

(57) ABSTRACT

A protective screen for use with a pitching machine. The pitching machine for pitching balls. The protective screen having a passageway defined there-through for permitting a ball to be pitched by the pitching machine there-through. The protective screen having a door configured for opening and closing in concert with the pitching of balls so as to open to permit a ball to be pitched there-through but automatically closed right there-behind to protect the operator of the pitching machine from injury due to a batted ball.

20 Claims, 5 Drawing Sheets

PORTABLE PROTECTION SCREEN FOR PITCHING MACHINE

CROSS-REFERENCE TO RELATED APPLICATIONS

This application claims the priority date of the provisional application entitled PORTABLE PROTECTION SCREEN FOR PITCHING MACHINE filed by Kim Cherry on Nov. 26, 2005 with application Ser. No. 60/597,345, the disclosure of which is incorporated herein by reference.

FIELD OF THE INVENTION

The present invention generally relates to devices and apparatuses used to train athletes to hit a moving ball, more particularly to portable protection screens for protecting a coach using a pitching machine to fire a ball towards a batter.

BACKGROUND OF THE INVENTION

The training of athletes, namely baseball and softball players, to properly hit baseballs/softballs is frequently done. Typically, a batter will spend time within a "batting cage" receiving balls pitched by a commercial pitching machine. Alternatively, portable pitching machines are known in the prior art and are utilized by coaches to pitch balls to batters.

Any time one is playing a sport such as baseball or softball, there is a chance that a person in the field will be struck by a batted ball. Within games it is not infrequent for a pitcher to be stricken by a batted ball, often causing injury to the pitcher. This same problem arises when coaches are pitching balls to batters during batting practice, whether they are pitching using a manually fed machine, other pitching machines which requires manual operation, or throwing the balls by hand.

Various different types of pitching screens are well known in the prior art for protecting and/or shielding the pitcher of the ball. Typically such devices have an upward extending portion for protecting the pitcher's body with a cut-out that allows the ball to be thrown over the top portion of the screen. A general example of such a screen can be seen in U.S. Pat. No. 6,955,615.

Screening set up with regard to pitching machines typically have a hole cut within the screening material so as to let the ball be projected through the hole and to the batter. An example of such a hole is shown in U.S. Pat. No. 5,195,744. Theoretically, a ball could be hit by a batter back through the hole (13) and strike the pitching machine and/or pitching machine operator.

What is needed is a portable protection screen for use with a pitching machine that protects an operator of the machine standing behind the screen but allows for complete and full operation of the pitching machine.

SUMMARY OF THE INVENTION

One embodiment of the present invention is a portable protection screen for use with a pitching machine. This screen comprising of a frame, a cover for the frame, a door portion and a door opening mechanism.

The frame is configured for resting upon a ground surface and supporting the cover. The frame in use would be positioned between the pitching machine/pitching machine operator and a batter batting a ball pitched by the pitching machine. The cover covers the frame and defines therethrough at least one passageway for remitting a ball pitched by the pitching machine to pass therethrough.

The door portion is configured for selectively covering the passageway through the cover. It is configured for opening to permit a ball pitched by the pitching machine to pass therethrough and is configured for closing after the ball passes therethrough so as to prevent the ball from being batted back through the passageway by the batter. The door portion has a first end configured for attaching to the cover and a second end configured for cooperating with the door opening mechanism. The door portion comprising a living hinge adjacent its attachment with a cover so that the door opening mechanism is able to cause the door portion to hinge at the living hinge. When the door opening mechanism opens the door, it flexes the hinge. When the door opening mechanism releases the door, the deflexation of the living hinge causes closure of the door.

The door opening mechanism is for selectively opening and closing the door portion. In this embodiment, the door opening mechanism comprises a rope interconnecting the second (bottom) end of the door portion with the pitching machine itself. In the preferred embodiment, this door opening mechanism comprises a rope which extends from the bottom end (second) of the door upwards across the upper surface of the frame and back to the pitching machine so that as the pitching machine is drawn backwards in preparation for firing the ball, the rope is likewise pulled backwards causing opening of the door. As the pitching machine then fires the ball, this tension on the rope is released, thereby allowing the door to snap back into position, closing the door behind the ball that was just fired through the door.

Still other features and advantages of the present invention will become readily apparent to those skilled in this art from the following detailed description describing only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
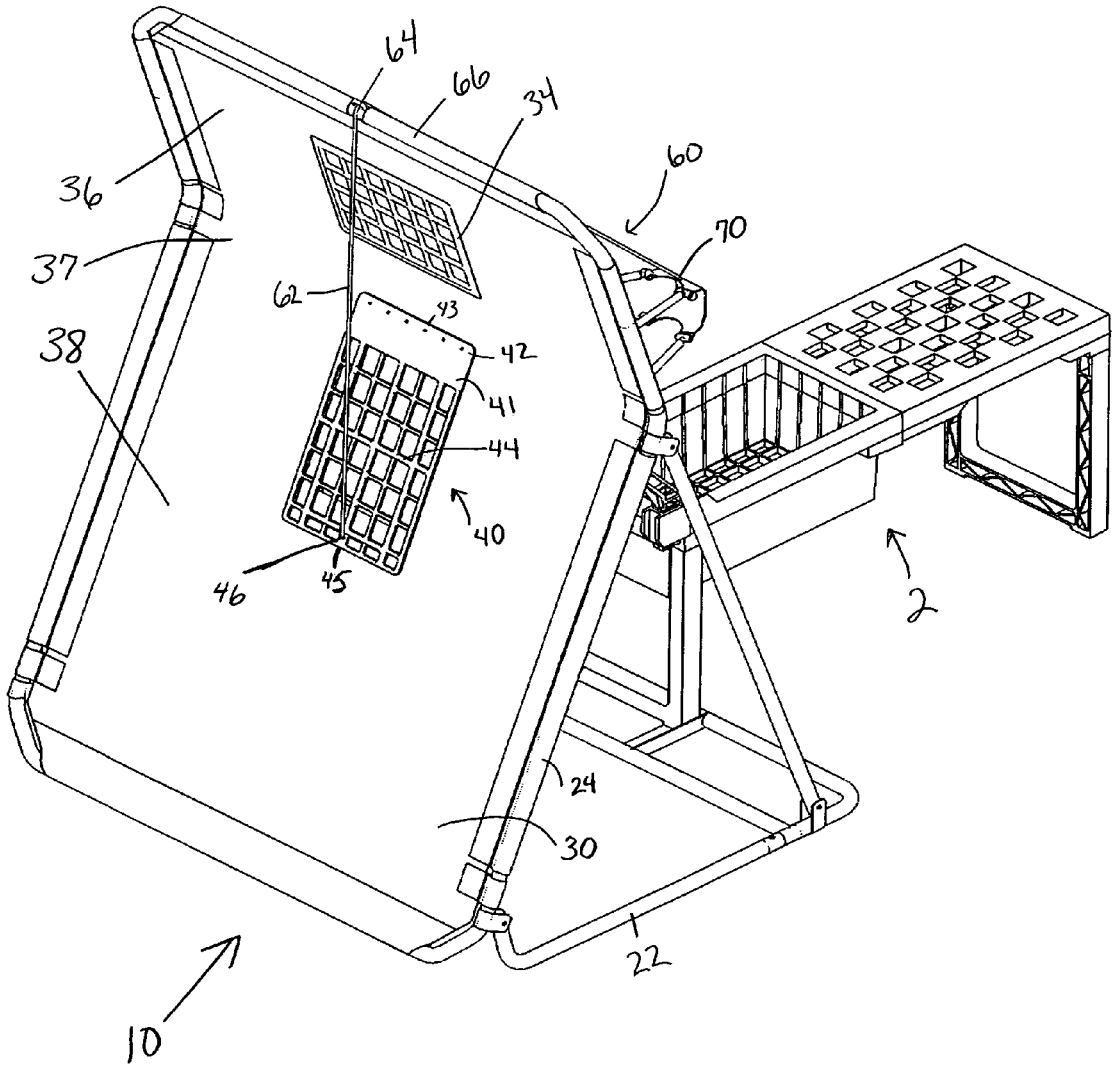
FIG. 1 is a perspective view of one embodiment of the present invention with its door closed, shown in front of a pitching machine.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Referring to FIGS. 1-5, shown is one embodiment of the present invention, a portable protection screen 10 for use with a pitching machine 2. The present invention is a portable protection screen 10 configured for use with a pitching machine 2.

Figure 4:
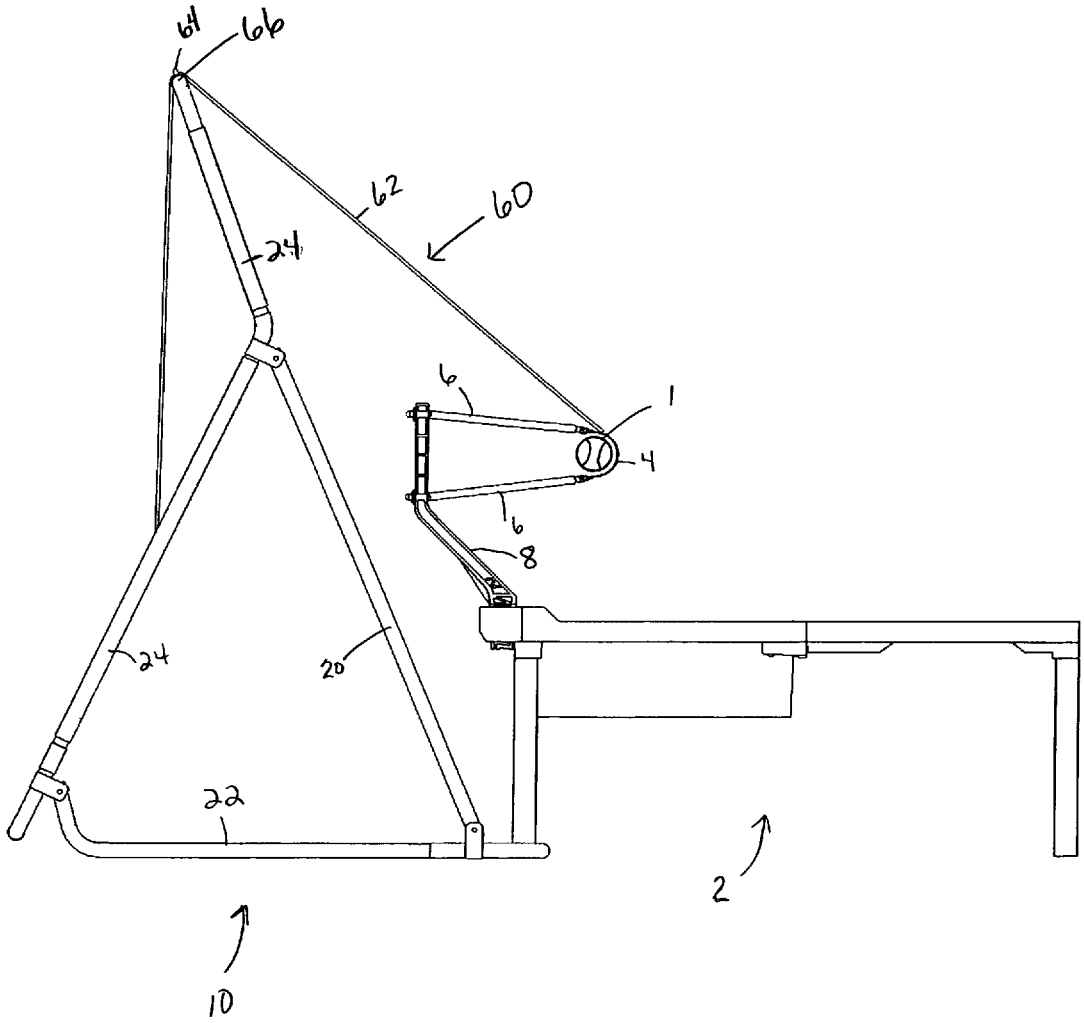
FIG. 4 is a first side view of the embodiment of FIG. 1, showing the door closed.
Figure 5:
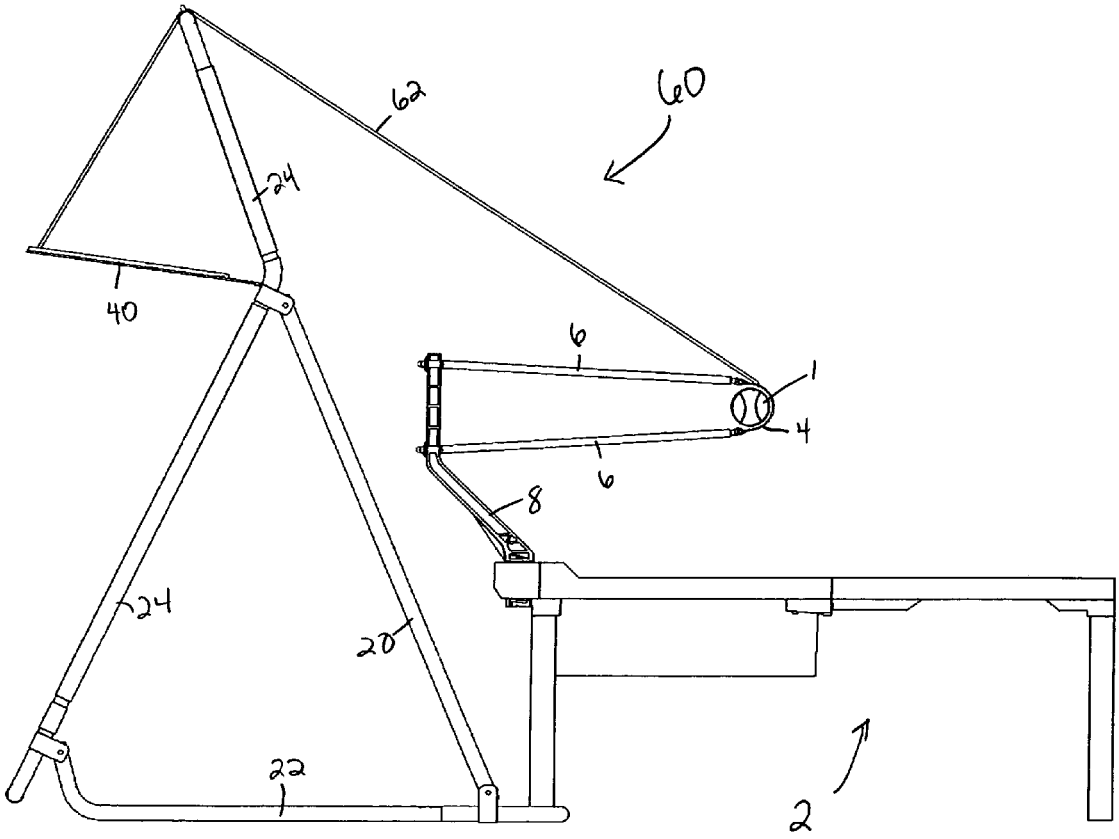
FIG. 5 is a second side view of the embodiment of FIG. 1, showing the door open and a ball ready to be pitched.

One particular example of a pitching machine can be seen in FIGS. 1, 4 and 5. This particular pitching machine is manufactured by and was likewise invented by the present inventor and is protected in U.S. Pat. No. 6,884,188. While the particular make and model of pitching machine 2 shown in this drawings is the preferred pitching machine for use with the embodiment of the present invention shown in the drawings, it is expressly noted that the technologies of the present invention may be applied to other types and manufactures of pitching machines and that the disclosure of this preferred pitching machine is not intended in any way to be a limitation upon the use of the present invention.

The portable pitching machine 2 having a frame, a pair of uprights 8, a pocket 4 and plurality of elastic connectors 6. Into the pocket would be inserted a ball 1. Such a pitching machine is utilized by drawing the pocket 4 backwards (generally to the right side of the drawing) as is shown in FIG. 5. To pitch the ball 1, the pocket 4 would then be released allowing the elastic bands 6 to draw the ball 1 back towards and through the uprights 8, thereby firing the ball 1 from the front (left side of figure) end of the pitching machine 2. With this type of pitching machine 2, a coach using it has the ability to vary the pitching style and/or location by adjusting the location of the pocket 4 when the pocket 4 is released.

The embodiment of the present invention shown in the drawings is a portable protection screen 10. This screen 10 having a frame 20 including a base 22 configured for resting upon a ground surface, as well as an upper portion(s) 24. The preferred frame comprising a number of interlocking metal tubes, is for instance aluminum. While metal is preferred, other materials may be used, including but not limited to plastics, wood and composites.

Although not directly shown in the drawings, it is envisioned that the frame 20 be made up of a number of different parts able to be quickly assembled together and/or disassembled apart. The frame 20 being configured in such a manner because the inventor envisions that this embodiment of the present invention would be much easier to ship, assemble and store that way. While such a configuration is viewed as preferred, it is not mandatory that any embodiment of the present invention be structured as such.

The present invention further having a cover 30 configured for covering the frame 20 and/or at least a portion of the frame 20. The cover 30 configured for protecting the user of the pitching machine 2, stopping and/or deflecting batted balls. The preferred cover 30 comprising a sheet of a durable fabric material (man-made or natural) having a plurality of hook-and-loop style fasteners allowing the cover to be stretched over the frame 20 and attached there-to.

Figure 2:
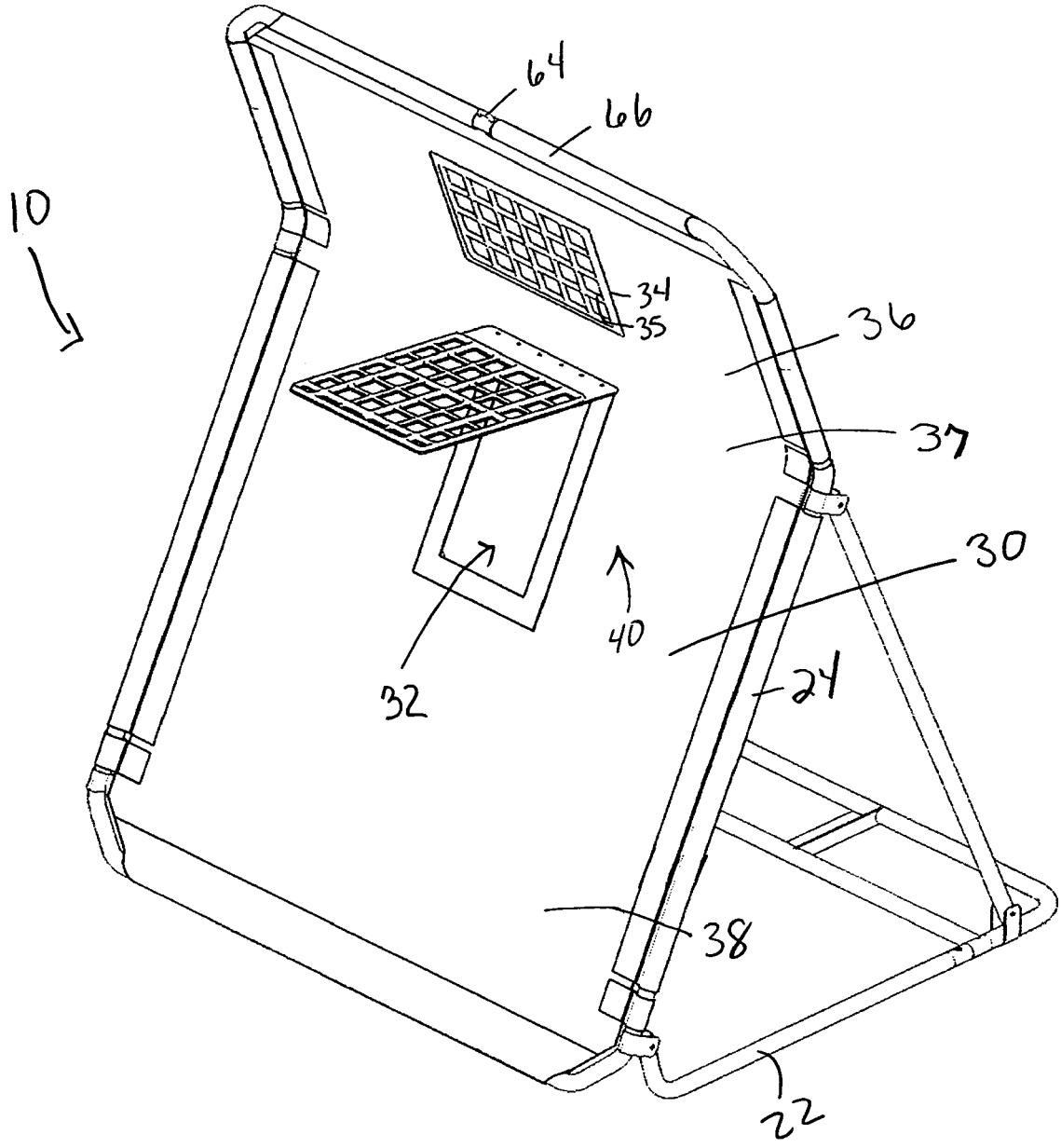
FIG. 2 a perspective view of the embodiment of the present invention show in FIG. 1, shown with its door open.
Figure 3:
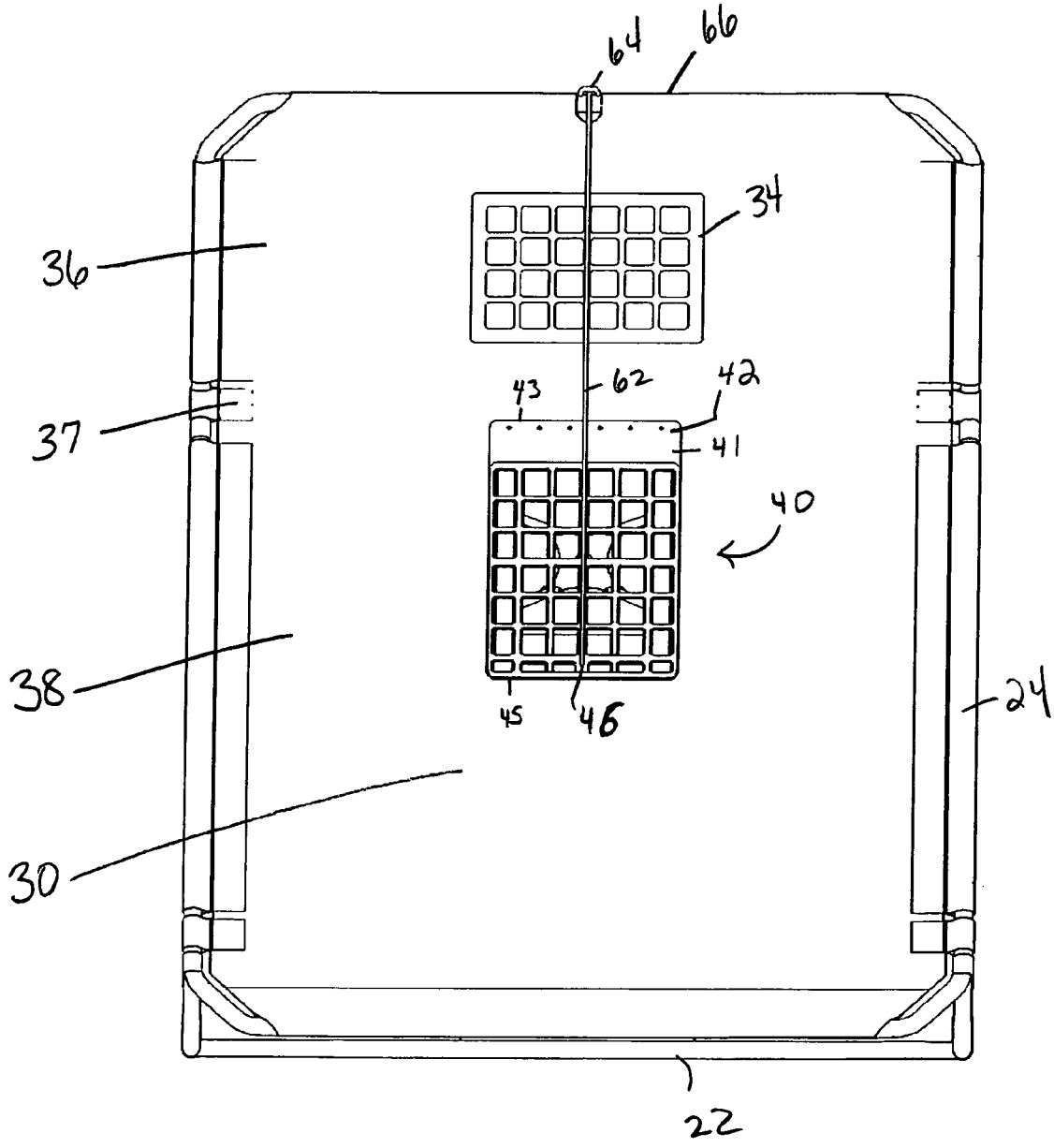
FIG. 3 is a front side view of the embodiment of the present invention shown in FIG. 1.

The cover 20 preferably defining therein a passageway 32 there-through (as particularly shown in FIG. 2). This passageway 32 configured in size, shape and orientation so that the pitching machine 2 can pitch balls through the passageway 32. In the case of the preferred pitching machine, the user of that particular type of pitching machine is able to adjust the location of the pitched ball by adjusting the angle and orientation of the pocket 4 relative to the arms 8 as the pocket is released and the ball 1 is pitched. Because of that, the passageway 32 of the preferred embodiment of the present invention (shown in the drawings) must be considerably larger than the diameter of the ball 1. Through this passageway 32 the pitching machine 2 pitches the ball 1.

It is preferred that the cover 30 likewise define at least one window portion 34 for allowing a user of the pitching machine 2 to see through the cover to the person he/she is pitching to. In the embodiment shown in the figures, the cover 30 is made of a solid material for durability and other reasons. If the cover was made from a mesh or a netting (as it could very well be made from in alternate embodiments), then such a window 34 may not be necessary. When the window 34 is present, it is preferred that a screen 35 cover the window so as to prevent a ball from being knocked through the window and striking the user of the device. The preferred screen 35 comprising a mesh window of hard plastic or rubber. The preferred screen material being polyurethane. Other materials may be used for the screen. Again, while a solid cover 30 is the preferred manner for construction of the present invention, the present invention is not intended in anyway to be limited to such manufacture and could likewise be made up of various types of clear materials, meshes, netting, etc.

It is preferred that the frame 20 and attached cover 30 be configured with an oblique angle therein. In such an arrangement (as shown in the figures), defined is a top panel section 36 and bottom panel section 38 joining together at a crease area 37. It is preferred that the crease area be reinforced. Such a oblique angle has the benefit of allowing a better angle for the connection between the door opening mechanism 60 (infra) and the door. It also aids in the dampening affect of the "living hinge" (infra).

Utilization of such a structure is also envisioned to prevent injury to a batter from balls which the batter hits which reflect off of the protection screen and back at the batter. In such a configuration such a ball should be deflected upwards or downwards instead of directly back at the batter. While such a structure is preferred, it is optional, for a planar surface could be provided, this planar surface generally perpendicular to the ground surface or at an angle there-to. Other configurations are likewise possible.

The present invention further comprising a door portion 40 configured for covering the passageway 32. In the embodiment of the present invention shown in the drawings, this door portion 40 having an attachment portion 42 configured for attachment to the cover 30, a first end 43 extending to a second end 45, and a living hinge portion 41 allowing the door portion 40 to be bent between its attachment portion 42 and its cover portion 44. The cover portion 44 preferably covered with an open mesh 44, however a solid covering could likewise be provided. The preferred door portion material being polyurethane. Additionally, it is provided that the door portion 40 further comprise a rope connection 46 for enabling the door portion 40 to connect to and be operated by the rope portion 62 of the door opening mechanism 60.

As indicated above, it is preferred that the door portion 40 have an attachment portion 42 which attaches to the cover 30 at or adjacent to the crease 37. In the preferred embodiment this attachment is made through use of #10 by ⅝" bolts with rubber washers and "Nylock-type" locking nuts. In such a configuration the door portion 40 by default would generally hang loosely over the passageway 32 thereby protecting balls hit from the batter to the portable protection screen 10 from passing through the passageway 32 and injuring an individual standing behind the screen. This door portion 40 can be attached to the cover 30 in any typical manner of doing so, including but not limited to sewing, pop rivets, fasteners, adhesives, etc. Likewise, the rest of the construction of the present invention can be manufactured and connected together through use of standard manners.

The door portion 40 configured for selectively opening and closing through use of a door opening mechanism 60. In the embodiment shown in the figures, the door opening mechanism 60 is configured for raising the second end 45 of the door portion 40 upwards, thereby opening the door and exposing the passageway 32. Further, it is preferred that the door portion be configured for automatically opening to permit a ball to be pitched there-through and automatically closing to prevent said pitched ball from being batted back through said passageway.

In the embodiment of the present invention shown in the drawings, the door opening mechanism 60 comprises a rope portion 62 connecting between the rope connection 46 of the door portion 40, over the frame upper cross bar 66 at a frame connection 64, and back to connect with the pitching machine 2. The preferred rope portion comprising a length of ⅛" diameter polyester or nylon rope, however other types of rope and other materials are likewise envisioned, including but not limited to cables, wires, ropes, chains, string, twine, etc.

Preferably, such a connection is configured so that as the pitching machine readies itself for pitching the ball, the door portion will open thereby exposing the passageway, as soon as the ball is fired by the pitching machine and passes through the passageway, the door portion will then close shut thereby preventing the ball from being batted back through the passageway and injuring the operator of the pitching machine.

In the embodiment shown in FIGS. 1, 4 and 5, this is accomplished through use of the rope portion 62 attaching between the rope connection 46 of the second end 45 of the door portion 40 and the pocket 4 of the pitching machine 2. It is preferred that a specialized rope clip or connector 70 be utilized to interconnect the rope portion with the pocket of the pitching machine. As such, as the pocket is pulled backwards, the rope portion itself is pulled as well, thereby resulting in the door portion 40 being bent at the living hinge 41 upwards. Upon releasing the pocket and firing the ball 1 through the passageway, the living hinge coupled with gravity would cause the door portion to close right behind the ball that was just fired through the passageway 32.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A portable protection screen in combination with a pitching machine having uprights and an open top container for storing balls and a seat, said screen comprising:

a frame, said frame configured for resting on a ground surface, said frame configured for supporting a cover, said frame positioned between said pitching machine and a batter batting a ball pitched by said pitching machine;

a cover for said frame, said cover configured for attaching to said frame, said cover defining there-through at least one passageway for permitting said ball pitched by said pitching machine to pass there-through;

a door portion, said door portion configured for covering said passageway through said cover, said door portion configured for opening to permit said ball to pass there-through and closing after said ball passes there-through so as to prevent said ball from being batted back through said passageway by said batter; and a door opening mechanism, said door opening mechanism for selectively opening and closing said door portion.

2. The portable protection screen of claim 1, wherein said frame and cover cooperate to define a top panel obtusely intersecting a bottom panel at a crease, said crease generally parallel to said ground surface, said obtusely intersecting panels thereby keeping a ball batted by said batter from ricocheting directly back to said batter.

3. The portable protection screen of claim 2, wherein said door opening mechanism comprises a rope portion and wherein said door portion has a first end attaching to said cover adjacent said crease and a second end attaching to said rope portion.

4. The portable protection screen of claim 2, wherein said passageway located in said bottom panel.

5. The portable protection screen of claim 2, further comprising a window portion for permitting an operator of said screen to see through said cover, said window portion defined in said top panel, said window portion covered with a screen.

6. The portable protection screen of claim 1, wherein said door opening mechanism comprises a rope portion.

7. The portable protection screen of claim 6, wherein said rope portion interconnects said pitching machine to said door so that as said pitching machine is readied for pitching, said door is opened automatically to permit said pitching machine to pitch a ball through said opening, and so that said door closes automatically behind said pitched ball thereby protecting a user operating said pitching machine.

8. The portable protection screen of claim 1, wherein said door portion has a first end attaching to said cover and a second end attaching to said door opening mechanism.

9. The portable protection screen of claim 8, wherein said door portion comprises a living hinge adjacent its attachment with said cover so that the door opening mechanism is able to cause the door portion to hinge at said living hinge.

10. The portable protection screen of claim 9, wherein said door opening mechanism is used to open said door thereby flexing said hinge.

11. The portable protection screen of claim 10, wherein the release of said door opening mechanism results in the deflexation of said living hinge and closure of said door.

12. The portable protection screen of claim 1, wherein said door portion comprises a protective screen portion for screening said opening, a living hinge portion for allowing said door portion to be opened and closed, and an attachment portion configured for attaching to said cover.

13. The portable protection screen of claim 1, wherein said door opening mechanism comprises a rope portion interconnecting said pitching machine to said door so that as said pitching machine is readied for pitching said door is opened automatically to permit said pitching machine to pitch a ball through said opening, said door then being closed automatically (through use of gravity) behind said pitched ball thereby protecting a user operating said pitching machine.

14. A portable protection screen in combination with a pitching machine having uprights and an option top container for storing balls and a seat, said screen comprising:

a frame, said frame configured for resting on a ground surface, said frame configured for supporting a cover, said frame positioned between said pitching machine and a batter batting a ball pitched by said pitching machine;

a cover for said frame, said cover configured for attaching to said frame, said cover defining there-through at least one passageway for permitting said ball pitched by said pitching machine to pass there-through;

a door portion, said door portion configured for covering said passageway through said cover, said door portion configured for opening to permit said ball to pass therethrough and closing after said ball passes there-through so as to prevent said ball from being batted back through said passageway by said batter, wherein said door portion has a first end attaching to said cover and a second end attaching to said door opening mechanism, wherein said door portion comprises a living hinge adjacent its attachment with said cover so that the door opening mechanism is able to cause the door portion to hinge at said living hinge, wherein said door opening mechanism is used to open said door thereby flexing said hinge, wherein the release of said door opening mechanism results in the deflexation of said living hinge and closure of said door; and a door opening mechanism, said door opening mechanism for selectively opening and closing said door portion.

15. The portable protection screen of claim 14, wherein said frame and cover cooperate to define a top panel obtusely intersecting a bottom panel at a crease, said crease generally parallel to said ground surface, said obtusely intersecting panels thereby keeping a ball batted by said batter from ricocheting directly back to said batter.

16. The portable protection screen of claim 15, wherein said door opening mechanism comprises a rope portion and wherein said door portion has a first end attaching to said cover adjacent said crease and a second end attaching to said rope portion, wherein said passageway located in said bottom panel.

17. The portable protection screen of claim 16, wherein said rope portion interconnects said pitching machine to said door so that as said pitching machine is readied for pitching said door is opened automatically to permit said pitching machine to pitch a ball through said opening, and so that said door closes automatically behind said pitched ball thereby protecting a user operating said pitching machine.

18. The portable protection screen of claim 14, wherein said door portion comprises a protective screen portion for screening said opening.

19. The portable protection screen of claim 14, wherein said door opening mechanism comprises a rope portion interconnecting said pitching machine to said door so that as said pitching machine is readied for pitching said door is opened automatically to permit said pitching machine to pitch a ball through said opening, said door then being closed automatically (through use of gravity) behind said pitched ball thereby protecting a user operating said pitching machine.

20. A portable protection screen in combination with a pitching machine having uprights and an open top container for storing balls and a seat, said screen comprising:

a frame, said frame configured for resting on a ground surface, said frame configured for supporting a cover, said frame positioned between said pitching machine and a batter batting a ball pitched by said pitching machine;

a cover for said frame, said cover configured for attaching to said frame, said cover defining there-through at least one passageway for permitting said ball pitched by said pitching machine to pass there-through;

a door portion, said door portion configured for covering said passageway through said cover, said door portion configured for opening to permit said ball to pass there-through and closing after said ball passes there-through so as to prevent said ball from being batted back through said passageway by said batter, wherein said door portion has a first end attaching to said cover and a second end attaching to said door opening mechanism, wherein said door portion comprises a living hinge adjacent its attachment with said cover so that the door opening mechanism is able to cause the door portion to hinge at said living hinge, wherein said door opening mechanism is used to open said door thereby flexing said hinge, wherein the release of said door opening mechanism results in the deflexation of said living hinge and closure of said door; and a door opening mechanism, said door opening mechanism for selectively opening and closing said door portion, wherein said door opening mechanism comprises a rope portion interconnecting said pitching machine to said door so that as said pitching machine is readied for pitching said door is opened automatically to permit said pitching machine to pitch a ball through said opening, said door then being closed automatically (through use of gravity) behind said pitched ball thereby protecting a user operating said pitching machine.

* * * * *